US012618159B2

(12) United States Patent
Ueno et al.

(10) Patent No.: US 12,618,159 B2
(45) Date of Patent: May 5, 2026

(54) CHEMICAL CONVERSION COATING AGENT, SURFACE-TREATED METAL AND SURFACE TREATMENT METHOD

(71) Applicant: NIPPON PAINT SURF CHEMICALS CO., LTD., Tokyo (JP)

(72) Inventors: Takayuki Ueno, Tokyo (JP); Yu Koganezawa, Tokyo (JP)

(73) Assignee: NIPPON PAINT SURF CHEMICALS CO., LTD., Tokyo (JP)

( * ) Notice: Subject to any disclaimer, the term of this patent is extended or adjusted under 35 U.S.C. 154(b) by 310 days.

(21) Appl. No.: 18/551,837

(22) PCT Filed: Mar. 24, 2022

(86) PCT No.: PCT/JP2022/013880
§ 371 (c)(1),
(2) Date: Sep. 21, 2023

(87) PCT Pub. No.: WO2022/210245
PCT Pub. Date: Oct. 6, 2022

(65) Prior Publication Data

US 2024/0200198 A1 Jun. 20, 2024

(30) Foreign Application Priority Data

Mar. 31, 2021 (JP) ..... 2021-060174
Dec. 17, 2021 (JP) ..... 2021-204975

(51) Int. Cl.
*C22C 28/00* (2006.01)
*C23C 22/34* (2006.01)
*C23C 28/00* (2006.01)
*C25D 9/02* (2006.01)

(52) U.S. Cl.
CPC ..... *C23C 28/00* (2013.01); *C23C 22/34* (2013.01); *C25D 9/02* (2013.01); *C23C 2222/20* (2013.01)

(58) Field of Classification Search
CPC ..... C23C 26/00; C23C 28/00; C23C 22/34; C23C 22/73; C23C 2222/20
See application file for complete search history.

(56) References Cited

U.S. PATENT DOCUMENTS

2009/0239093 A1 9/2009 Inbe et al.
2010/0028541 A1 2/2010 Nagai et al.
2015/0176136 A1 6/2015 Toi et al.
2021/0172068 A1 6/2021 Suzuki et al.
2022/0316084 A1 10/2022 Ueno et al.

FOREIGN PATENT DOCUMENTS

| | | | |
|---|---|---|---|
| CN | 101395299 | A | 3/2009 |
| CN | 111212932 | A | 5/2020 |
| EP | 2 280 094 | A1 | 2/2011 |
| JP | H09302026 | A | 11/1997 |
| JP | 2004218074 | A | 8/2004 |
| JP | 2005336550 | A | 12/2005 |
| JP | 2008261035 | A | 10/2008 |
| JP | 2009234010 | A | 10/2009 |
| JP | 2010163640 | A | 7/2010 |
| JP | 2019081940 | A | 5/2019 |
| JP | 2020090625 | A | 6/2020 |
| KR | 10-2004-0058037 | A | 7/2004 |
| KR | 2004-0058038 | A | 7/2004 |

OTHER PUBLICATIONS

Notice of Reasons for Rejection mailed Feb. 1, 2022 in corresponding JP Application 2021-204975, with machine English translation.
Extended Search Report for EP Application No. 22780459.8 dated Mar. 25, 2025 is attached (8 pages).
Office Action for CN Application No. 202280025215.1, dated May 16, 2024 and its English translation is attached (22 pgs).
Office Action mailed Mar. 20, 2026 issued in the Korea Patent Application No. KR10-2023-7037308 (with English translation), 16 pages.

*Primary Examiner* — Jessee R Roe
(74) *Attorney, Agent, or Firm* — MUNCY, GEISSLER, OLDS & LOWE, P.C.

(57) ABSTRACT

A chemical conversion coating agent that enables chemical conversion coating by which favorable corrosion resistance is obtained after coating. A chemical conversion coating agent which contains (A) at least one metal component that is selected from the group consisting of zirconium, titanium and hafnium, (B) fluorine and (C) an allylamine-diallylamine copolymer, wherein the content of the metal component (A) is 10 to 10,000 ppm by mass in terms of elemental metal relative to the total mass of the chemical conversion coating agent; the content ratio of a diallylamine segment derived from diallylamine in the allylamine-diallylamine copolymer (C) is 52% to 98% by mole relative to the total of an allylamine segment derived from allylamine and the diallylamine segment; the weight average molecular weight of the allylamine-diallylamine copolymer (C) is 500 to 500,000; and the content of the allylamine-diallylamine copolymer (C) is 25 to 5,000 ppm by mass in terms of the resin solid content concentration relative to the total mass of the chemical conversion coating agent.

16 Claims, No Drawings

CHEMICAL CONVERSION COATING AGENT, SURFACE-TREATED METAL AND SURFACE TREATMENT METHOD

TECHNICAL FIELD

The present invention relates to a chemical conversion coating agent, a surface-treated metal, and a surface treatment method.

BACKGROUND ART

Conventionally, chemical conversion coating has been previously applied to a metal substrate surface for the purpose of improving corrosion resistance, coating film adhesiveness, and the like when applying cationic electrodeposition coating or powder coating to metal substrate surfaces. In recent years, chemical conversion coatings using a chromium-free zinc phosphate have been widely performed.

The chemical conversion coating using zinc phosphate is difficult from the viewpoint of waste water treatment due to a high reactivity of the treatment agent and has had a problem of a great environmental burden in addition to generation of sludges. Thus, chemical conversion coating agents composed of at least one selected from a group consisting of zirconium, titanium, and hafnium, as well as fluorine and a water-soluble resin have been proposed (e.g. see Patent Document 1).

Patent Document 1: Japanese Unexamined Patent Application, Publication No. 2004-218074

DISCLOSURE OF THE INVENTION

Problems to be Solved by the Invention

The technology disclosed in Patent Document 1 makes it possible to apply a good chemical conversion coating to metals such as iron, zinc, and aluminum. However, corrosion resistance obtained after cationic electrodeposition coating, powder coating, or the like has still had room for improvement.

The present invention was made in view of the above circumstances, and an object of the present invention is to provide a chemical conversion coating agent that enables a chemical conversion coating with favorable corrosion resistance after coating.

Means for Solving the Problems (1) The present invention relates to a chemical conversion coating agent including (A) at least one metal component selected from a group consisting of zirconium, titanium, and hafnium, (B) fluorine and (C) an allylamine-diallylamine copolymer, in which the content of the metal component (A) is 10 to 10,000 ppm by mass in terms of elemental metal relative to the total mass of the chemical conversion coating agent; the content ratio of a diallylamine segment derived from the diallylamine in the allylamine-diallylamine copolymer (C) is 52% to 98% by mole relative to the total of an allylamine segment derived from the allylamine and the diallylamine segment; the allylamine-diallylamine copolymer (C) has a weight average molecular weight of 500 to 500,000; and the content of the allylamine-diallylamine copolymer (C) is 25 to 5,000 ppm by mass in terms of resin solid content concentration relative to the total mass of the chemical conversion coating agent.

(2) The chemical conversion coating agent according to (1), further including at least one metal component selected from a group consisting of aluminum and zinc.

(3) The chemical conversion coating agent according to (1) or (2), in which the chemical conversion coating agent has a pH of 2.0 to 6.0.

(4) The chemical conversion coating agent according to any one of (1) to (3), in which the allylamine-diallylamine copolymer (C) is an acid addition salt having anionic counter ions, and an acid constituting the acid addition salt has a dissociation constant (pKa) in a range of −3.7 to 4.8.

(5) The chemical conversion coating agent according to any one of (1) to (4), in which a concentration of the fluorine (B) is 10 to 12,500 ppm by mass in terms of elemental fluorine relative to the total mass of the chemical conversion coating agent.

(6) The chemical conversion coating agent according to any one of (1) to (5), further including a silane coupling agent.

(7) A surface-treated metal, having a surface on which a chemical conversion film is formed by the chemical conversion coating agent according to any one of (1) to (6).

(8) The surface-treated metal according to (7), in which a content of the metal component (A) in the chemical conversion film is 5 to 500 $mg/m^2$ in terms of elemental metal.

(9) A surface treatment method including forming a chemical conversion film by treating a surface of a coat object with the chemical conversion coating agent according to any one of (1) to (6).

(10) The surface treatment method according to (9), further including forming an electrodeposited coating film by subjecting the coat object having the chemical conversion film to electrodeposition coating.

Effects of the Invention

According to the present invention, it is possible to provide a chemical conversion coating agent that enables chemical conversion coating with favorable corrosion resistance after coating.

PREFERRED MODE FOR CARRYING OUT THE INVENTION

The embodiments of the present invention will be explained below. The present invention is not limited to the description of the following embodiment.

<Chemical Conversion Coating Agent>

By the chemical conversion coating agent according to the present embodiment, a chemical conversion film with favorable corrosion resistance after coating can be formed on a surface of a metal substrate. The metal substrate on which the chemical conversion film is formed and applied can be used for various applications such as automobile bodies and automobile parts without particular limitation. Examples of the coating include cationic electrodeposition coating, powder coating, aqueous coating, and solvent coating.

The chemical conversion coating agent according to the present embodiment includes at least one metal component (A) selected from a group consisting of zirconium, titanium, and hafnium, as well as fluorine (B) and an allylamine-diallylamine copolymer (C).

(Metal Component (A))

The metal component (A) is a chemical conversion film-forming component. A chemical conversion film containing at least one metal component (A) selected from a group consisting of zirconium, titanium, and hafnium is formed on a metal substrate, so that corrosion resistance and wear resistance of the metal substrate can be improved, and the adhesiveness of the metal substrate to a coating film such as an electrodeposited coating film can be improved.

Examples of the source for the zirconium include, but are not particularly limited to, an alkali metal fluorozirconate such as $K_2ZrF_6$, fluorozirconic acid ($H_2ZrF_6$), ammonium hexafluorozirconate ($(NH_4)_2ZrF_6$), ammonium zirconium carbonate ($(NH_4)_2ZrO(CO_3)_2$), tetraalkyl ammonium modified zirconium, zirconium fluoride, zirconium oxide, and the like.

Examples of the sources of titanium include, but are not particularly limited to, soluble fluorotitanates, e.g. alkali metal fluorotitanate, fluorotitanate such as $(NH_4)_2TiF_6$, and fluorotitanate acid such as $H_2TiF_6$, as well as titanium fluoride, and titanium oxide.

Examples of the sources of hafnium include, but are not particularly limited to, fluorohafnate acid such as $H_2HfF_6$, and hafnium fluoride.

The content of the metal component (A) is 10 to 10000 ppm by mass in terms of elemental metal relative to the total mass of the chemical conversion coating agent. If the content of metal component (A) is less than 10 ppm, the performance of the resulting chemical conversion film is insufficient. If the content of the metal component (A) is more than 10000 ppm by mass, additional effects cannot be obtained, resulting in economical disadvantage. From the above viewpoint, the content of the metal component (A) is preferably 50 to 2000 ppm by mass, more preferably 50 to 800 ppm in terms of elemental metal.

(Fluorine (B))

Fluorine (B) has a function of etching the surface of the metal substrate. Examples of the sources of fluorine include, but are not particularly limited to, fluorides such as hydrofluoric acid, ammonium fluoride, fluoboric acid, ammonium hydrogen fluoride, sodium fluoride, and sodium hydrogen difluoride. Examples of complex fluorides include hexafluorosilicate, specifically hydrofluorosilicic acid, zinc hydrogen fluorosilicate, manganese hydrogen fluorosilicate, magnesium hydrogen fluorosilicate, nickel hydrogen fluorosilicate, iron hydrogen fluorosilicate, and calcium hydrogen fluorosilicate. The fluorine-containing compound such as alkali metal fluorozirconate described as the source for the metal component (A) as an example can be not only the source for the metal component (A) but also the source for fluorine (B).

Preferably, the concentration of fluorine (B) is 10 to 12500 ppm by mass in terms of elemental fluorine relative to the total mass of the chemical conversion coating agent. If the concentration of fluorine (B) is less than 10 ppm by mass, etching is insufficient, and a good chemical conversion film cannot be obtained. If the concentration of fluorine (B) is more than 12500 ppm by mass, etching is excessive, and a chemical conversion film cannot be sufficiently formed. From the above viewpoint, it is more preferable that the concentration of fluorine (B) is 62.5 to 2500 ppm by mass. As a method for measuring the concentration of fluorine (B), for example, the concentration is measured by a quantitative analysis using ion chromatography.

(Allylamine-Diallylamine Copolymer (C))

The allylamine-diallylamine copolymer (C) has, as structural units, at least both a segment derived from allylamine and a segment derived from diallylamine (hereinafter, referred to as "allylamine segment" and "diallylamine segment" in some cases). Each of these segments may be independently in a quaternized state. Each of these segments may independently have counter ions.

In the present embodiment, a content ratio of the diallylamine segment in the allylamine-diallylamine copolymer (C) is 52% by mol or higher and 98% by mol or lower. The content ratio of the diallylamine segment is defined as a molar percentage of the diallylamine segment relative to the sum of the allylamine segment and the diallylamine segment in the allylamine-diallylamine copolymer (C). If the content ratio of the diallylamine segment is lower than 52% by mol, favorable corrosion resistance after coating is insufficient. If the content ratio of the diallylamine segment is higher than 98% by mol, the adhesiveness of the chemical conversion film to the coating film is deteriorated. From the above viewpoint, the content ratio of the diallylamine segment is preferably 55% by mol or higher and 98% by mol or lower, more preferably 80% by mol or higher and 98% by mol or lower. The diallylamine segment may include e.g. a heterocyclic structure represented by the following general formulas (1a) and (1b). The heterocyclic structure may be a saturated heterocyclic structure.

[Chem. 1]

(1a)

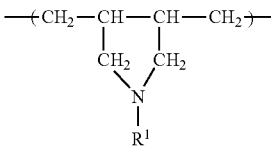

(1b)

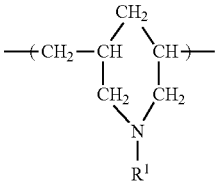

(wherein, $R^1$ represents a hydrogen atom, an alkyl group, or an aralkyl group.)

In the allylamine-diallylamine copolymer (C), the allylamine segment is represented by e.g. the following general formula (2).

[Chem. 2]

(2)

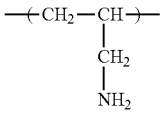

The allylamine-diallylamine copolymer (C) is preferably an acid addition salt having anionic counter ions to ammonium cations. A dissociation constant pKa of the acid constituting the acid addition salt is preferably in a range of −3.7 to 4.8. Note that, in this specification, the dissociation constant pKa of the acid means a value as measured using water as a solvent at 25° C. The diallylamine segment constituting the allylamine-diallylamine copolymer (C) as the acid addition salt is represented by e.g. the following general formulas (1c) and (1d).

[Chem. 3]

(1c)

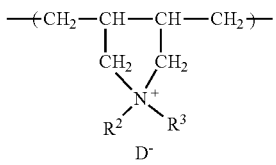

(1d)

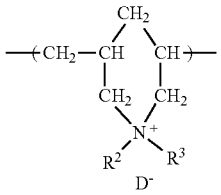

(wherein, $R^2$ and $R^3$ represent a hydrogen atom, an alkyl group, or an aralkyl group, and D– represents a monovalent anion.)

Examples of the anionic counter ions include, but are not particularly limited to, monovalent negative ions, e.g. carboxylic acid ions such as formic acid ions, acetic acid ions, and benzoic acid ions, chloride ions, sulfate ions, and nitrate ions. Examples of the acid constituting the acid addition salt include organic acids such as formic acid, acetic acid, and benzoic acid, as well as inorganic acids such as hydrochloric acid, sulfuric acid, and nitric acid.

The allylamine-diallylamine copolymer (C) may have the segment other than segment derived from the allylamine and the diallylamine segment, if necessary. Examples of the segment include segments derived from N,N-dialkylaminoalkyl(meth)acrylate and its salt or quaternized product, N,N-dialkylaminoalkyl(meth)acrylamide and its salt or quaternized product, vinylimidazole and its salt or quaternized product, vinylpyridine and its salt or quaternized product, N-alkylallylamine and its salt, N,N-dialkylallylamine and its salt, N-alkyldiallylamine and its salt or quaternized product, or the like.

The allylamine-diallylamine copolymer (C) may further have segments other than the segments listed above, if necessary. Examples of the other segments include segments derived from sulfur dioxide, an unsaturated compound having a hydroxy group such as 2-hydroxyethyl (meth)acrylate, a (meth)acrylic acid alkyl ester such as methyl (meth) acrylate and ethyl (meth)acrylate, a vinyl carboxylate such as vinyl acetate and vinyl propionate, an unsaturated acid, and a (meth)acrylamide.

A content ratio of the segments other than the allylamine-derived and diallylamine-derived segments in the allylamine-diallylamine copolymer (C) is preferably 20% or lower, more preferably 10% or lower, most preferably 0%. The content ratio of the segments derived from neither the allylamine segment nor diallylamine segment is defined as a molar percentage of segments that are neither the allylamine segment nor diallylamine segment relative to the total of all segments in the allylamine-diallylamine copolymer (C).

The content of the allylamine-diallylamine copolymer (C) is 25 to 5000 ppm by mass in terms of resin solid content concentration relative to the total mass of the chemical conversion coating agent. If the content is less than 25 ppm by mass, adhesiveness of the chemical conversion film is insufficient. If the content is more than 5000 ppm by mass, formation of the chemical conversion film may be inhibited. From the above viewpoint, the content of the allylamine-diallylamine copolymer (C) is preferably 50 to 1500 ppm by mass, more preferably 50 to 600 ppm by mass in terms of resin solid content concentration.

The allylamine-diallylamine copolymer (C) has a weight average molecular weight of 500 to 500,000. If the weight average molecular weight is less than 500, adhesiveness of the chemical conversion film is insufficient. If the weight average molecular weight is more than 500,000, formation of the chemical conversion film may be inhibited. From the above viewpoint, the weight average molecular weight of the allylamine-diallylamine copolymer (C) is preferably 5000 to 100000.

The weight average molecular weight of the allylamine-diallylamine copolymer (C) can be measured e.g. by gel permeation chromatography (GPC). For example, L-6000 type high-performance liquid chromatograph manufactured by Hitachi, Ltd. can be used as a measurement apparatus, L-6000 manufactured by Hitachi, Ltd. can be used as an eluent flow pump, a Shodex RI SE-61 differential refractive index detector can be used as a detector, and Asahipak aqueous gel filtration types GS-220HQ (exclusion limit molecular weight: 3,000) and GS-620HQ (exclusion limit molecular weight: 2,000,000) which are connected can be used as a column. An example of the GPC measurement method is described below. A concentration of a sample is adjusted to 0.5 g/100 ml with an eluent, and 20 μl of the sample is used. As the eluent, 0.4 mol/L sodium chloride aqueous solution is used. The measurement is carried out with a column temperature of 30° C. and a flow rate of 1.0 ml/min. A calibration curve is determined using polyethylene glycol with a molecular weight of 106, 194, 440, 600, 1470, 4100, 7100, 10300, 12600, 23000, or the like as a standard sample. A weight average molecular weight (Mw) of the copolymer is determined on the basis of the calibration curve.

The allylamine-diallylamine copolymer (C) may be modified unless the object of the present invention is impaired. For example, a part of the amino group of the allylamine-diallylamine copolymer (C) may be modified by an acetylation method or the like, or may be cross-linked by a cross-linking agent without affecting the solubility.

Examples of the method of preparing the allylamine-diallylamine copolymer (C) include, but are not particularly limited to, a method in which a monomer mixture of allylamine, diallylamine, and, if necessary, other components is subjected to a radical polymerization in an appropriate solvent and in the presence of a radical polymerization initiator. For the polymerization conditions, conditions known to those skilled in the art can be selected as appropriate.

(Other Polymers)

The chemical conversion coating agent according to the present embodiment may contain polymers other than the allylamine-diallylamine copolymer (C). Examples of the polymers other than the allylamine-diallylamine copolymer (C) include polymer components e.g. a polyallylamine resin, a polyvinylamine resin, a polydiallylamine resin, a urethane resin, an acrylic resin, a polyester resin, a natural polymer derivative such as a chitin/chitosan derivative and a cellulose derivative. When the chemical conversion coating agent according to the present embodiment contains polymers other than the allylamine-diallylamine copolymer (C), a solid content mass of the allylamine-diallylamine copolymer (C) relative to the total solid content mass of all polymers is preferably 80% by mass or more, more preferably 90% by mass or more, most preferably 95% by mass or more.

(Other Components)

Preferably, the chemical conversion coating agent according to the present embodiment further contain a silane coupling agent. When a silane coupling agent is contained in the chemical conversion coating agent, the adhesiveness of the chemical conversion film to the coating film can be further improved. As the silane coupling agent, it is preferable to use, without particular limitation, one or a plurality of silane coupling agents selected from a group consisting of an amino group-containing silane coupling agent, an epoxy group-containing silane coupling agent, a hydrolysate of an amino group-containing silane coupling agent, a hydrolysate of an epoxy group-containing silane coupling agent, a polymer of an amino group-containing silane coupling agent, and a polymer of an epoxy group-containing silane coupling agent.

Examples of the amino group-containing silane coupling agent include, but are not particularly limited to, known silane coupling agents such as N-2(aminoethyl)3-aminopropylmethyldimethoxysilane, N-2(aminoethyl)3-aminopropyltrimethoxysilane, N-2(aminoethyl)3-aminopropyltriethoxysilane, 3-aminopropyltrimethoxysilane, 3-aminopropyltriethoxysilane, 3-triethoxysilyl-N-(1,3-dimethyl-butylidene) propylamine, N-phenyl-3-aminopropyltrimethoxysilane, and N,N-bis [3-(trimethoxysilyl) propyl] ethylenediamine. It is also possible to use commercially available amino group-containing silane coupling agents KBM-602, KBM-603, KBE-603, KBM-903, KBE-9103, KBM-573 (manufactured by Shin-Etsu Chemical Co., Ltd.), and the like.

The hydrolysates of the amino group-containing silane coupling agents can be produced by a conventionally known method e.g. a method in which the amino group-containing silane coupling agent is dissolved in ion-exchanged water and adjusted to be acidic with any acid. As the hydrolysate of the amino group-containing silane coupling agent, it is also possible to use a commercially available product such as KBP-90 (manufactured by Shin-Etsu Chemical Co., Ltd.: 32% active ingredient).

Examples of the epoxy group-containing silane coupling agent include, but are not limited to, 3-glycidoxypropyltrimethoxysilane, 3-glycidoxypropyltriethoxysilane, 3-glycidoxypropylmethyldimethoxysilane, 3-glycidoxypropylmethyldiethoxysilane, 3-glycidoxypropyldiethylethoxysilane, 2-(3,4-epoxycyclohexyl) ethyltrimethoxysilane, 2-(3,4-epoxycyclohexyl)ethyltriethoxysilane, and 5,6-epoxyhexyltriethoxysilane. It is also possible to use commercially available products such as "KBM-403", "KBE-403", "KBE-402", "KBE-303", (manufactured by Shin-Etsu Chemical Co., Ltd.), and the like.

The chemical conversion coating agent according to the present embodiment may contain components other than those described above. For example, it is preferable that the chemical conversion coating agent further contains at least one metal component selected from a group consisting of aluminum and zinc as the chemical conversion film-forming component. This makes it possible to further improve the corrosion resistance of the metal substrate on which the chemical conversion film is formed. In addition to those described above, at least one metal component selected from a group consisting of magnesium, calcium, gallium, indium, and copper may be contained as the chemical conversion film-forming component. Also, metal components such as manganese, iron, cobalt, nickel, and chromium may be contained. Examples of the sources of the film-forming components include, but are not particularly limited to, oxides, hydroxides, fluorides, chlorides, sulfates, nitrates, borates, carbonates, and organic acids, of each metal. As components eluted from the metal substrate to be subjected to chemical conversion coating in a chemical conversion coating bath, the metal components of the film-forming components may be contained in the chemical conversion coating agent.

The chemical conversion coating agent according to the present embodiment may contain an oxidizing agent. For example, it is preferable that the chemical conversion coating agent further contains at least one oxidizing agent selected from a group consisting of nitric acid and nitrous acid as a chemical conversion film-forming component. This makes it possible to enhance the formation of the chemical conversion film to further improve the corrosion resistance of the metal substrate. As the oxidizing agent, inorganic acids or their salts are considered to enhance the reaction of forming the chemical conversion coating. Examples of the inorganic acid include nitric acid, nitrous acid, hydrochloric acid, bromic acid, chloric acid, hydrogen peroxide, $HMnO_4$, and $HVO_3$. The metal surface treatment composition may contain a sulfonic acid group-containing compound or a salt thereof as the oxidizing agent. The inorganic acids or their salts are considered to enhance the reaction of forming the chemical conversion coating as the oxidizing agent. Examples of the inorganic acid include nitric acid, nitrous acid, hydrochloric acid, bromic acid, chloric acid, hydrogen peroxide, $HMnO_4$, and $HVO_3$. The metal surface treatment composition may contain a sulfonic acid group-containing compounds or salts thereof as the oxidizing agent. Examples of the oxidizing agent include inorganic acids or their salts. Examples of the inorganic acid include nitric acid, nitrous acid, hydrochloric acid, bromic acid, chloric acid, hydrogen peroxide, $HMnO_4$, and $HVO_3$. The metal surface treatment composition may contain a sulfonic acid group-containing compounds or salts thereof as the oxidizing agent.

Preferably, the chemical conversion coating agent according to the present embodiment contains substantially no phosphate ions. In this specification, "contains substantially no phosphate ions" means that phosphate ions are contained so as not to act as a component in the chemical conversion coating agent. Since the chemical conversion coating agent according to the present embodiment contains substantially no phosphate ions, phosphorus that causes environmental burden is not substantially used. In addition, it is possible to suppress generation of sludges such as iron phosphate and zinc phosphate, which are generated in use of a zinc phosphate treatment agent.

(pH)

Preferably, the chemical conversion coating agent is at pH 2.0 to 6.0. If the pH is lower than 2.0, etching is excessive, and a chemical conversion film cannot be sufficiently formed. If the pH is higher than 6.0, etching is insufficient, and a good chemical conversion film cannot be obtained. From the above viewpoint, the pH is more preferably 2.0 to 5.5, further preferably 3.0 to 4.5. For the purpose of adjusting the pH of the chemical conversion coating agent, acidic compounds such as nitric acid and sulfuric acid, as well as basic compounds such as sodium hydroxide, potassium hydroxide, and ammonia can be used.

<Surface-Treated Metal>

The chemical conversion coating agent according to the present embodiment makes it possible to produce a surface-treated metal through formation of the chemical conversion film on the surface of the metal substrate as the coat object. The surface-treated metal according to the present embodiment has excellent adhesiveness between the coating film and the metal as well as corrosion resistance when the coating film such as an electrodeposited coating film is further formed on the chemical conversion film. Examples of the metal substrate include, but are not limited to, an iron substrate, an aluminum substrate, and a zinc substrate. Herein, the iron substrate, the aluminum substrate, and the zinc substrate mean an iron substrate composed of iron and/or an alloy thereof, an aluminum substrate composed of aluminum and/or an alloy thereof, and a zinc substrate composed of zinc and/or an alloy thereof, respectively. The metal substrate may be composed of a plurality of metal substrates selected from iron substrates, aluminum substrates, and zinc substrates.

The chemical conversion coating agent according to the present embodiment can impart sufficient coating film adhesiveness even to an iron substrate difficult to exhibit sufficient coating film adhesiveness in a conventional chemical conversion coating agent. The iron substrate is made of e.g. a cold-rolled steel sheet, a hot-rolled steel sheet, a mild steel sheet, and a high-tensile steel sheet, without particular limitation. The chemical conversion coating agent according to the present embodiment can impart favorable corrosion resistance and adhesiveness even to a high-tensile steel sheet with a thick oxide film, a cold-rolled steel sheet with a thin oxide film, and the like.

Examples of the aluminum substrate include, but are not particularly limited to, No. 5000 series aluminum alloys and No. 6000 series aluminum alloys. Examples of the zinc substrate include, but are not particularly limited to, zinc or zinc alloy-plated steel sheets e.g. a zinc-based electroplated, hot-dip plated, or vapor-deposited plated steel sheet, such as a zinc-plated steel sheet, a zinc-nickel plated steel sheet, a zinc-iron plated steel sheet, a zinc-chromium plated steel sheet, a zinc-aluminum plated steel sheet, a zinc-titanium plated steel sheet, a zinc-magnesium plated steel sheet, and a zinc-manganese plated steel sheet.

Preferably, the surface-treated metal according to the present embodiment has a metal component (A) content of 5 to 500 $mg/m^2$ in terms of elemental metal in the chemical conversion film formed by the chemical conversion coating agent. If the metal component (A) content is less than 5 $mg/m^2$, the chemical conversion film is even. If the metal component (A) content is more than 500 $mg/m^2$, additional effects cannot be obtained, resulting in economical disadvantage. The metal component (A) content is preferably 5 to 200 $mg/m^2$. In addition, a ratio of the carbon content to the metal component (A) content C/A is preferably 10 to 27% in the chemical conversion film formed by the chemical conversion coating agent.

<Surface Treatment Method>

The surface treatment method for treating the surface of the metal substrate using the chemical conversion coating agent according to the present embodiment may include a chemical conversion film forming process and an electrodeposited coating film forming process.

(Chemical Conversion Film Forming Process)

In the chemical conversion film forming process, a chemical conversion film is formed on the surface of the metal substrate to produce a surface-treated metal. The chemical conversion film forming process is performed by bringing the chemical conversion coating agent into contact with the surface of the metal substrate. Examples of the contacting method include, but are not limited to, an immersion method, a spray method, and a roll coating method. Preferably, a treatment temperature in the chemical conversion film forming process can be in a range of 15 to 70° C., preferably in a range of 30 to 50° C. A treatment time in the chemical conversion film forming process can be in a range of 5 to 1200 seconds, preferably in a range of 30 to 120 seconds.

(Electrodeposited Coating Film Forming Process)

In the electrodeposited coating film forming process, the surface-treated metal produced in the chemical conversion film forming process is subjected to electrodeposition coating to form an electrodeposited coating film on the surface. The electrodeposition coating is not particularly limited, and, for example, it is possible to use cationic electrodeposition coating. A cationic electrodeposition paint used for the cationic electrodeposition coating is not particularly limited, and it is possible to use a conventionally known cationic electrodeposition paint made of an aminated epoxy resin, an aminated acrylic resin, an epoxy resin in a sulfonium form, or the like. The electrodeposition coating method using the electrodeposition paint is not particularly limited, and it is possible to use a known electrodeposition coating method.

(Other Processes)

In the surface treatment method according to the present embodiment, a degreasing treatment process and a rinsing with water process after degreasing may be performed before the chemical conversion film forming process. In addition, a post-chemical conversion water-rinsing process may be performed after the chemical conversion film forming process and before the electrodeposited coating film forming process.

In the degreasing treatment process, immersion treatment with a dewaxing agent such as a phosphorus-free/nitrogen-free dewaxing detergent is performed e.g. at 30 to 55° C. for about several minutes. A pre-dewaxing treatment may also be performed prior to the dewaxing process.

In the rinsing with water process after degreasing, the dewaxing agent is rinsed with water after the dewaxing treatment, in which the dewaxing agent is sprayed with a large amount of rinse water once or several times.

In the rinsing with water process after chemical conversion, the spraying treatment or an immersion water-rinsing is carried out once or several times without affecting the adhesiveness and the corrosion resistance after the coating. It is preferable to carry out the final water-rinsing treatment using ion-exchanged water or pure water. If necessary, a process to dry the surface-treated metal may be performed after the rinsing with water process after chemical conversion.

In the above embodiment, the surface treatment method for treating the surface of the metal substrate was explained as a method including the electrodeposited coating film forming process. The surface treatment method according to the present invention may include, instead of the electrodeposited coating film forming process, a process in which the coat object having the chemical conversion film is subjected to powder coating, aqueous coating, or solvent coating. The process including the powder coating, the aqueous coating, or the solvent coating is not particularly limited, and a conventionally known method can be used. The chemical conversion coating agent according to the present embodiment can also allow the coating film formed by the powder coating, the aqueous coating, or the solvent coating to acquire a corrosion resistance equivalent to that imparted to the electrodeposited coating film.

EXAMPLES

The content of the present invention will be explained below in more detail on the basis of Examples. The content of the present invention is not limited to the description in the following Examples.

Example 1

A commercially available cold-rolled steel sheet (SPCC-SD, manufactured by Nippon Testpanel Co., Ltd, 70 mm×150 mm×0.8 mm) was used as the metal substrate, and its surface was treated under the following conditions.

As the degreasing treatment process, the substrate was immersed in 2% by mass of "Surf Cleaner 53" (dewaxing agent, manufactured by Nippon Paint Surf Chemicals, Inc.) at 40° C. for 2 minutes. As the rinsing with water process after degreasing, the substrate was sprayed with tap water for 30 seconds. As the chemical conversion coating process, the chemical conversion coating agent was prepared using fluorozirconic acid and an allylamine-diallylamine copolymer (allylamine segment: 40% by mol, diallylamine segment: 60% by mol, molecular weight: 100,000, acetic acid (pKa 4.8) salt) such that a Zr content was 50 ppm by mass in terms of elemental metal, a fluorine concentration was 62.5 ppm by mass, and an allylamine-diallylamine copolymer content was 600 ppm by mass in terms of resin solid content concentration as presented in Table 1. The pH was adjusted to 4 using sodium hydroxide. The temperature of the chemical conversion coating agent was adjusted to 40° C., and the metal substrate was immersed in the chemical conversion coating agent for 120 seconds.

As the rinsing with water process after chemical conversion, the substrate was sprayed with tap water for 30 seconds. Furthermore, the substrate was sprayed with ion-exchanged water for 30 seconds. Subsequently, as the drying treatment, the substrate was dried in an electric drying furnace at 80° C. for 5 minutes. The content ($mg/m^2$) of Zr as the metal component (A) and the content ($mg/m^2$) of the allylamine-diallylamine copolymer (C) in the chemical conversion film were measured using "ZSX Primus II" (X-ray analyzer manufactured by Rigaku Corporation), and the results were presented in Table 1.

As the electrodeposited coating film forming process, the substrate was subjected to electrodeposition coating so as to have a dried film thickness of 20 μm using "POWERNICS 310" (cationic electrodeposition paint manufactured by NIPPON PAINT AUTOMOTIVE COATINGS CO., LTD.), then rinsed with water, and then the coating film was baked by heating at 170° ° C. for 20 minutes to prepare a test sheet of Example 1. In Tables 1 and 2, the "Zr film amount" represents the content of zirconium as the metal component (A) in the chemical conversion film, and the "C film amount" represents the content of carbon in the chemical conversion film.

Examples 2 to 25 and Comparative Examples 1 to 13

The test plates of Examples and Comparative Examples were prepared in the same manner as in Example 1, except that the composition of the chemical conversion coating agent in the chemical conversion coating process was as presented in Tables 1 and 2, and the temperature of the chemical conversion coating agent in Examples 24 and 25 was as presented in Table 1. The detailed compositions of the chemical conversion coating agents in Examples and Comparative Examples are as described below.

In Examples 14, 15, and 23, and Comparative Examples 9 and 10, each chemical conversion coating agent was prepared so as to contain aluminum nitrate nonahydrate and zinc nitrate hexahydrate in amounts presented in Table 1 in terms of elemental metal. Each chemical conversion coating agent was prepared using KBM-603 (N-2-(aminoethyl)-3-aminopropyltrimethoxysilane (manufactured by Shin-Etsu Chemical Co., Ltd.)) as the silane coupling agent in Example 16, or using KBM-903 (3-aminopropyltrimethoxysilane (manufactured by Shin-Etsu Chemical Co., Ltd.)) as the silane coupling agent in Examples 22 and 25, or using KBP-90 (hydrolyzed condensate of amino group-containing silane compound, manufactured by Shin-Etsu Chemical Co., Ltd.) as the silane coupling agent in Examples 23. In Comparative Example 2, the chemical conversion coating agent was prepared without using the allylamine-diallylamine copolymer (C). In Comparative Examples 4 and 9, an allylamine polymer (C) with a diallylamine segment content ratio of 0% by mol was used instead of the allylamine-diallylamine copolymer (C). In Comparative Examples 7 and 10, a diallylamine polymer (C) with a diallylamine segment content ratio of 100% by mol was used instead of the allylamine-diallylamine copolymer (C). In Comparative Example 8, a copolymer (C) with a diallylamine segment content ratio of 100% by mol and additionally a segment derived from sulfur dioxide was used instead of the allylamine-diallylamine copolymer (C). In Comparative Example 11, a mixture of an allylamine polymer (C) (50 ppm by mass, molecular weight: 3000) with a diallylamine segment content ratio of 0% by mol and a diallylamine polymer (C) (500 ppm by mass, molecular weight: 50000) with a diallylamine segment content ratio of 100% by mol was used instead of the allylamine-diallylamine copolymer (C). In Comparative Example 12, a copolymer (C) with a diallylamine segment content ratio of 100% by mol and additionally a segment derived from maleic acid was used instead of the allylamine-diallylamine copolymer (C). In Comparative Example 13, polymaleic acid was used instead of the allylamine-diallylamine copolymer (C). In Examples and Comparative examples, hydrochloric acid was used as the additional acid with pKa of −3.7.

[Liquid Stability Evaluation]

To evaluate a liquid stability when a dewaxing liquid was added, each chemical conversion coating agent according to Examples and Comparative Examples was mixed with "Surf Cleaner 53" 2% dewaxing liquid in an outer percentage of 1%, the mixture was wholly stirred, and left to stand at 40° C. for 60 minutes, and then a bathing state of the chemical conversion coating agent was visually observed. The liquid stability was evaluated in accordance with the following criteria. Chemical conversion coating agents scored as 3 or higher were evaluated to be acceptable. The results are presented in Tables 1 and 2.

3: No precipitates
2: Little precipitates
1: Much precipitates

[Secondary Adhesiveness Test (SDT)]

Two vertically-parallel notches that reach the base metal were made on each test sheet of Examples and Comparative Examples, and then, the sheet was immersed in a 5% NaCl aqueous solution at 50° C. for 480 hours. Subsequently, the notched portions were subjected to tape peeling, and portions from which the paint had been peeled off were observed. The adhesiveness was evaluated in accordance with the following criteria. The test sheets scored as 2 or higher were evaluated to be acceptable. The results were presented in Tables 1 and 2.

3: No peeling

2: Peeling width of smaller than 3 mm

1: Peeling width of 3 mm or larger

[Compound Cyclic Corrosion Test (CCT)]

A cross-shaped notch that reaches the base metal was made on each test sheet according to the Examples and Comparative Examples, and then a compound cyclic corrosion test was performed. As the test method, 100 cycles of combined tests were performed in accordance with Japanese Automotive Standards Organization (JASO) M609-91. After the test, the maximum expanded width between the both sides from the notched portion was measured. The corrosion resistance was evaluated in accordance with the following criteria. Test sheets scored as 3 or higher were evaluated to be acceptable. The results are presented in Tables 1 and 2.

4: Smaller than 4.0 mm

3: 4.0 mm or larger and smaller than 6.0 mm

2: 6.0 mm or larger and smaller than 8.0 mm

1: 8.0 mm or larger

TABLE 1

| | | Chemical conversion coating agent | | | | | | | | |
|---|---|---|---|---|---|---|---|---|---|---|
| | | Metal component (A) | | Fluorine (B) | Allylamine-diallylamine copolymer (C) | | | | Silane coupling agent | |
| | | Type | ppm by mass | ppm by mass | Weight average molecular weight | Diallylamine segment (% by mol) | Additional acid pKa | ppm by mass | Type | ppm by mass |
| Examples | 1 | Zr | 50 | 62.5 | 100000 | 60 | 4.8 | 600 | — | — |
| | 2 | Zr | 75 | 93.75 | 40000 | 80 | 4.8 | 500 | — | — |
| | 3 | Zr | 100 | 125 | 40000 | 95 | 4.8 | 400 | — | — |
| | 4 | Zr | 600 | 750 | 20000 | 60 | −3.7 | 200 | — | — |
| | 5 | Zr | 500 | 625 | 80000 | 80 | −3.7 | 250 | — | — |
| | 6 | Zr | 450 | 562.5 | 40000 | 95 | −3.7 | 300 | — | — |
| | 7 | Zr | 50 | 62.5 | 20000 | 60 | 4.8 | 200 | — | — |
| | 8 | Zr | 75 | 93.75 | 50000 | 80 | 4.8 | 250 | — | — |
| | 9 | Zr | 100 | 125 | 40000 | 95 | 4.8 | 200 | — | — |
| | 10 | Zr | 600 | 750 | 40000 | 60 | 4.8 | 600 | — | — |
| | 11 | Zr | 500 | 625 | 30000 | 80 | −3.7 | 500 | — | — |
| | 12 | Zr | 400 | 500 | 40000 | 95 | −3.7 | 400 | — | — |
| | 13 | Zr | 400 | 500 | 40000 | 55 | 4.8 | 250 | — | — |
| | 14 | Zr | 600 | 750 | 50000 | 60 | 4.8 | 300 | — | — |
| | 15 | Zr | 350 | 437.5 | 20000 | 60 | −3.7 | 200 | — | — |
| | 16 | Zr | 400 | 500 | 40000 | 95 | −3.7 | 150 | KBM-603 | 30 |
| | 17 | Zr | 800 | 1000 | 70000 | 80 | 4.8 | 200 | — | — |
| | 18 | Zr | 200 | 250 | 40000 | 95 | −3.7 | 150 | — | — |
| | 19 | Zr | 100 | 125 | 20000 | 98 | 4.8 | 50 | — | — |
| | 20 | Zr | 800 | 1000 | 50000 | 90 | −3.7 | 1500 | — | — |
| | 21 | Zr | 700 | 875 | 40000 | 95 | 4.8 | 75 | — | — |
| | 22 | Zr | 500 | 625 | 20000 | 80 | −3.7 | 350 | KBM-903 | 90 |
| | 23 | Zr | 200 | 250 | 40000 | 90 | 4.8 | 200 | KBP-90 | 10 |

| | | Chemical conversion coating agent | | | Chemical conversion film | | Evaluation | | |
|---|---|---|---|---|---|---|---|---|---|
| | | Other components | | | Zr film | C film | | | |
| | | Type | ppm by mass | pH | amount [mg/m$^2$] | amount [mg/m$^2$] | Liquid stability | SDT | CCT |
| Examples | 1 | — | 0 | 4.0 | 45 | 11.9 | 3 | 3 | 3 |
| | 2 | — | 0 | 4.0 | 32 | 7.3 | 3 | 3 | 3 |
| | 3 | — | 0 | 4.0 | 36 | 8.0 | 3 | 3 | 3 |
| | 4 | — | 0 | 4.0 | 55 | 10.3 | 3 | 3 | 3 |
| | 5 | — | 0 | 4.0 | 63 | 9.8 | 3 | 3 | 3 |
| | 6 | — | 0 | 4.0 | 50 | 9.9 | 3 | 3 | 4 |
| | 7 | — | 0 | 4.0 | 53 | 9.6 | 3 | 3 | 3 |
| | 8 | — | 0 | 4.0 | 42 | 8.0 | 3 | 3 | 3 |
| | 9 | — | 0 | 4.0 | 41 | 9.1 | 3 | 3 | 3 |
| | 10 | — | 0 | 4.0 | 52 | 12.5 | 3 | 3 | 3 |
| | 11 | — | 0 | 4.0 | 41 | 8.1 | 3 | 3 | 3 |
| | 12 | — | 0 | 4.0 | 42 | 7.6 | 3 | 3 | 3 |
| | 13 | — | 0 | 4.0 | 57 | 14.8 | 3 | 3 | 3 |
| | 14 | $Al(NO_3)_3 \cdot 9H_2O$ | 250 | 4.0 | 59 | 13.1 | 3 | 3 | 4 |
| | 15 | $Zn(NO_3)_2 \cdot 6H_2O$ | 2000 | 4.0 | 55 | 14.4 | 3 | 3 | 3 |
| | 16 | — | 0 | 4.0 | 35 | 6.6 | 3 | 3 | 3 |
| | 17 | — | 0 | 4.0 | 66 | 13.5 | 3 | 3 | 3 |
| | 18 | — | 0 | 4.0 | 48 | 9.3 | 3 | 3 | 4 |
| | 19 | — | 0 | 4.0 | 45 | 8.8 | 3 | 3 | 3 |

TABLE 1-continued

| | | | | | | | | | |
|---|---|---|---|---|---|---|---|---|---|
| 20 | — | 0 | 4.0 | 52 | 11.1 | 3 | 3 | 3 |
| 21 | — | 0 | 4.0 | 66 | 6.8 | 3 | 3 | 3 |
| 22 | — | 0 | 4.0 | 40 | 7.6 | 3 | 3 | 3 |
| 23 | $Zn(NO_3)_2 \cdot 6H_2O$ | 500 | 4.0 | 42 | 8.7 | 3 | 3 | 3 |

TABLE 2

| | | Chemical conversion coating agent | | | | | | | | |
|---|---|---|---|---|---|---|---|---|---|---|
| | | Metal component (A) | | Fluorine (B) | (Co)polymer (C) | | | | Silane coupling agent | |
| | | Type | ppm by mass | ppm by mass | Weight average molecular weight | Diallylamine segment (% by mol) | Additional acid pKa | ppm by mass | Type | ppm by mass |
| Comparative Examples | 1 | Zr | 5 | 6.25 | 40000 | 60 | −3.7 | 200 | — | — |
| | 2 | Zr | 300 | 375 | — | — | — | 0 | — | — |
| | 3 | Zr | 800 | 1000 | 40000 | 80 | 4.8 | 20 | — | — |
| | 4 | Zr | 100 | 125 | 3000 | 0 | – | 500 | — | — |
| | 5 | Zr | 300 | 375 | 20000 | 20 | −3.7 | 300 | — | — |
| | 6 | Zr | 600 | 750 | 70000 | 50 | −3.7 | 400 | — | — |
| | 7 | Zr | 100 | 125 | 50000 | 100 | −3.7 | 200 | — | — |
| | 8 | Zr | 300 | 375 | 5000 | 100 | −3.7 | 200 | — | — |
| | 9 | Zr | 200 | 250 | 15000 | 0 | — | 50 | — | — |
| | 10 | Zr | 300 | 375 | 5000 | 100 | — | 300 | — | — |
| | 11 | Zr | 200 | 250 | 3000/5000 | 0/100 | —/−3.7 | 50/500 | — | — |
| | 12 | Zr | 200 | 250 | 16000 | 100 | −3.7 | 400 | — | — |
| | 13 | Zr | 500 | 625 | 1000 | 0 | — | 200 | — | — |

| | | Chemical conversion coating agent | | | Chemical conversion film | | | | |
|---|---|---|---|---|---|---|---|---|---|
| | | Other components | | | Zr film | C film | Evaluation | | |
| | | Type | ppm by mass | pH | amount [mg/m²] | amount [mg/m²] | Liquid stability | SDT | CCT |
| Comparative Examples | 1 | — | 0 | 4 | 28 | 20.2 | 3 | 1 | 1 |
| | 2 | — | 0 | 4 | 100 | 0 | 1 | 1 | 1 |
| | 3 | — | 0 | 4 | 92 | 6.6 | 3 | 1 | 1 |
| | 4 | — | 0 | 4 | 78 | 7.7 | 3 | 3 | 1 |
| | 5 | — | 0 | 4 | 82 | 5.6 | 3 | 3 | 1 |
| | 6 | — | 0 | 4 | 76 | 24.2 | 3 | 3 | 1 |
| | 7 | — | 0 | 4 | 38 | 5.8 | 1 | 1 | 3 |
| | 8 | — | 0 | 4 | 39 | 4.8 | 1 | 1 | 3 |
| | 9 | $Al(NO_3)_3 \cdot 9H_2O$ | 200 | 4 | 90 | 7.8 | 2 | 2 | 2 |
| | 10 | $Al(NO_3)_3 \cdot 9H_2O$ | 400 | 4 | 44 | 12.2 | 1 | 1 | 2 |
| | 11 | — | 0 | 4 | 45 | 9.1 | 2 | 2 | 3 |
| | 12 | — | 0 | 4 | 36 | 4.2 | 2 | 1 | 3 |
| | 13 | — | 0 | 4 | 87 | 2.3 | 1 | 1 | 1 |

From the results of Tables 1 and 2, it was confirmed that the chemical conversion coating agents according to each Example had superior liquid stability and favorable favorable corrosion resistance after coating compared to the chemical conversion coating agents according to Comparative Examples.

The invention claimed is:

1. A chemical conversion coating agent comprising (A) at least one metal component selected from a group consisting of zirconium, titanium, and hafnium, (B) fluorine and (C) an allylamine-diallylamine copolymer, wherein:

a content of the metal component (A) is 10 to 10,000 ppm by mass in terms of elemental metal relative to a total mass of the chemical conversion coating agent;

a content ratio of a diallylamine segment derived from the diallylamine in the allylamine-diallylamine copolymer (C) is 52% to 98% by mole relative to a total of an allylamine segment derived from the allylamine and the diallylamine segment;

the allylamine-diallylamine copolymer (C) has a weight average molecular weight of 500 to 500,000; and a content of the allylamine-diallylamine copolymer (C) is 25 to 5,000 ppm by mass in terms of resin solid content concentration relative to the total mass of the chemical conversion coating agent.

2. The chemical conversion coating agent according to claim 1, further comprising at least one metal component selected from a group consisting of aluminum and zinc.

3. The chemical conversion coating agent according to claim 2, wherein the chemical conversion coating agent has a pH of 2.0 to 6.0.

4. The chemical conversion coating agent according to claim 2, wherein the allylamine-diallylamine copolymer (C) is an acid addition salt having anionic counter ions, and an acid constituting the acid addition salt has a dissociation constant (pKa) in a range of −3.7 to 4.8.

5. The chemical conversion coating agent according to claim 2, wherein a concentration of the fluorine (B) is 10 to 12,500 ppm by mass in terms of elemental fluorine relative to the total mass of the chemical conversion coating agent.

6. The chemical conversion coating agent according to claim 1, wherein the chemical conversion coating agent has a pH of 2.0 to 6.0.

7. The chemical conversion coating agent according to claim 6, wherein the allylamine-diallylamine copolymer (C) is an acid addition salt having anionic counter ions, and an acid constituting the acid addition salt has a dissociation constant (pKa) in a range of −3.7 to 4.8.

8. The chemical conversion coating agent according to claim 6, wherein a concentration of the fluorine (B) is 10 to 12,500 ppm by mass in terms of elemental fluorine relative to the total mass of the chemical conversion coating agent.

9. The chemical conversion coating agent according to claim 1, wherein the allylamine-diallylamine copolymer (C) is an acid addition salt having anionic counter ions, and an acid constituting the acid addition salt has a dissociation constant (pKa) in a range of −3.7 to 4.8.

10. The chemical conversion coating agent according to claim 9, wherein a concentration of the fluorine (B) is 10 to 12,500 ppm by mass in terms of elemental fluorine relative to the total mass of the chemical conversion coating agent.

11. The chemical conversion coating agent according to claim 1, wherein a concentration of the fluorine (B) is 10 to 12,500 ppm by mass in terms of elemental fluorine relative to the total mass of the chemical conversion coating agent.

12. The chemical conversion coating agent according to claim 1, further comprising a silane coupling agent.

13. A surface-treated metal, having a surface on which a chemical conversion film is formed by the chemical conversion coating agent according to claim 1.

14. The surface-treated metal according to claim 13, wherein a content of the metal component (A) in the chemical conversion film is 5 to 500 $mg/m^2$ in terms of elemental metal.

15. A surface treatment method comprising forming a chemical conversion film by treating a surface of a coat object with the chemical conversion coating agent according to claim 1.

16. The surface treatment method according to claim 15, further comprising forming an electrodeposited coating film by subjecting the coat object having the chemical conversion film to electrodeposition coating.

* * * * *